United States Patent [19]

Silliman

[11] 4,073,205

[45] Feb. 14, 1978

[54] CHILD RESISTANT CONTAINER OPENER

[76] Inventor: William Arthur Silliman, 1755 Sherington Place, Apartment W102, Newport Beach, Calif. 92660

[21] Appl. No.: 684,264

[22] Filed: May 7, 1976

[51] Int. Cl.[2] ..... B67B 7/44

[52] U.S. Cl. ..... 81/3.1 R; 81/3.46 A; 81/3.4

[58] Field of Search ..... 81/3.1 R, 3.4, 3.46 A, 81/3.46 R, 3.3 R, 3.34, 120

[56] References Cited

U.S. PATENT DOCUMENTS

| | | | |
|---|---|---|---|
| D. 126,253 | 4/1941 | Smiley | 81/3.34 |
| D. 169,490 | 5/1953 | Hug | 7/14.6 |
| 763,745 | 6/1904 | Gheen | 81/120 |
| 2,031,420 | 2/1936 | Lebherz | 81/3.46 |
| 3,120,771 | 2/1964 | Woodbury | 81/3.4 |
| 3,143,904 | 8/1964 | Yerkes | 81/3.46 X |
| 3,760,657 | 9/1973 | Muir | 81/3.4 |

FOREIGN PATENT DOCUMENTS

| | | | |
|---|---|---|---|
| 772,929 | 4/1957 | United Kingdom | 81/3.4 |

*Primary Examiner*—James L. Jones, Jr.
*Assistant Examiner*—Roscoe V. Parker
*Attorney, Agent, or Firm*—Lawrence D. Sassone

[57] ABSTRACT

The invention is a container opener for child resistant containers. The container opener comprises a body having a notch and friction means on the notch surface such as triangular shaped pointed teeth, or a plurality of protrusions extending into the notch, and a blade. An alignment wall facilitates aligning a cover of the container to the friction means. The cover of the container is inserted into the notch and the cover is pressed against the friction means and the container opener is then rotated to align the cover of the container so that the cover will unlock from the receptacle of the container. The cover of the container is removed by inserting and twisting the blade between the cover and the receptacle of the container.

2 Claims, 13 Drawing Figures

CHILD RESISTANT CONTAINER OPENER

BACKGROUND OF THE INVENTION

Each year hundreds of children are killed by poisons. In response to this laws now require the use of child resistant containers for poisons and prescription drugs, among others. Most child resistant containers require that the cover be rotated and aligned and then be pried off. Great frictional forces must be overcome to rotate and align the cover and to pry the cover off. The covers are very narrow and difficult to grasp. This makes it very difficult for children to open the container, but unfortunately, it makes it difficult also for adults. This difficulty is heightened for adults who are ill or have physical handicaps. Many adults resolve this difficulty by waiting for help to open the container, by not taking their medicine, leaving the cover off, breaking the container, or transferring the contents to an easy open container which is more susceptible to being opened by children.

Older people have the most difficult time opening the child resistant containers and are more likely to transfer the medications into easy open containers. This is unfortunate because most old people are grandparents and have children frequently around. The older people are more likely to have medication and are more likely to have the more dangerous medications to treat their heart, inability to sleep, nervousness and anxiety, and depressions. If these older people had a quick simple way to open the child resistant containers, then they would be less inclined to transfer their medicines to the easy open containers.

There are more than 2,000 accidental poisonings resulting in death each year and of these 500 to 600 are children under the age of 5 years. It is estimated that there are approximately 600,000 to several million incidents of poisoning each year. The death rate in children from the ages of 1 to 4 from poisoning is 2.5 per 100,000. The top three causes of poisoning are salicylate, commonly called aspirin, vitamins with iron and tranquilizers. All three of these are commonly found in most homes. Most deaths to children result from salicylates. A child who eats poison once is 9 times more likely to eat poison again in the next year and 25 to 80 percent of the children who eat poison repeat again.

Apparently there are no opening devices designed specifically for opening child resistant containers. Present openers for similar containers require moving parts or levers, such as pliars, or large handles that must be made of metal for strength and are bulky in size. By contrast the invention herein has no moving parts or levers, does not require a handle, need not be made of metal and is compact in size. Apparently the only present method of opening child resistant containers is by one's hands which is impossible for some adults to do.

SUMMARY OF THE INVENTION

The present invention relates to a container opener for child resistant containers. It is an object of the present invention to provide an opener for child resistant containers that will make the opening and removal of the covers of the child resistant containers easier and quicker by providing means to align the cover to the receptacle and in other embodiments of the invention by prying the cover off. A further object of the invention is to provide such a container opener that will be light weight, easy to carry and use, and convenient to store.

The present invention in a preferred embodiment is a container opener for child resistant containers comprising a plastic body having a side surface and a bottom surface, a notch in the bottom surface, the notch generally in the shape of an isosceles right triangle having a hypotenus length on the side surface of the body and a first nonhypotenus length and a second non hypotenus length and an opening in the side surface of the body along the hypotenus length of the notch; a plurality of triangular shaped pointed teeth coupled to the first nonhypotenus surface, the teeth extending into the notch; a plurality of triangular shaped pointed teeth coupled to the second nonhypotenus surface, the teeth extending into the notch; a blade formed by a thin section of the body having a prying edge recessed in the body; a metal plate sonic welded to the prying edge of the blade and extending therefrom; and an alignment wall coupled to the body over the notch extending from the hypotenus length of the notch to the first nonhypotenus length of the notch and to the second nonhypotenus length of the notch.

Another embodiment of the invention is a container opener for child resistant containers, comprising a body having a notch and a notch surface and friction means on the notch surface. It is further preferred that a blade is coupled to the body wherein the blade is a thin section of the body and has a prying edge recessed in the body and a metal plate is couple to the prying edge and extends therefrom. Where the body is plastic it is a preferred embodiment that the metal plate is sonic welded to the prying edge. It is also a preferred embodiment that alignment means are coupled to the body over the notch and that the alignment means comprises a wall coupled to the body over the notch.

The friction means may comprise a plurality of protrusions extending into the notch, a notch sawtooth surface, a plurality of triangular shaped pointed teeth extending into the notch, a plurality of ribs extending into the notch, an adhesive substance, or a compressible substance, among others.

In one preferred embodiment the notch has a substantially triangular shape and the shape is preferably that of an isosceles right triangular shape.

In another embodiment the container opener for child resistant containers comprises a body having a hole and a surface partially surrounding the hole and friction means on the surface partially surrounding the hole. In a preferred embodiment the hole is substantially in the shape of a half circle. In another preferred embodiment the hole is substantially in the shape of a parabola.

DETAILED DESCRIPTION

Figures 1, 2, 3, 4, 5, 6, 7, 8, 9, 10, 11, 12, 13:
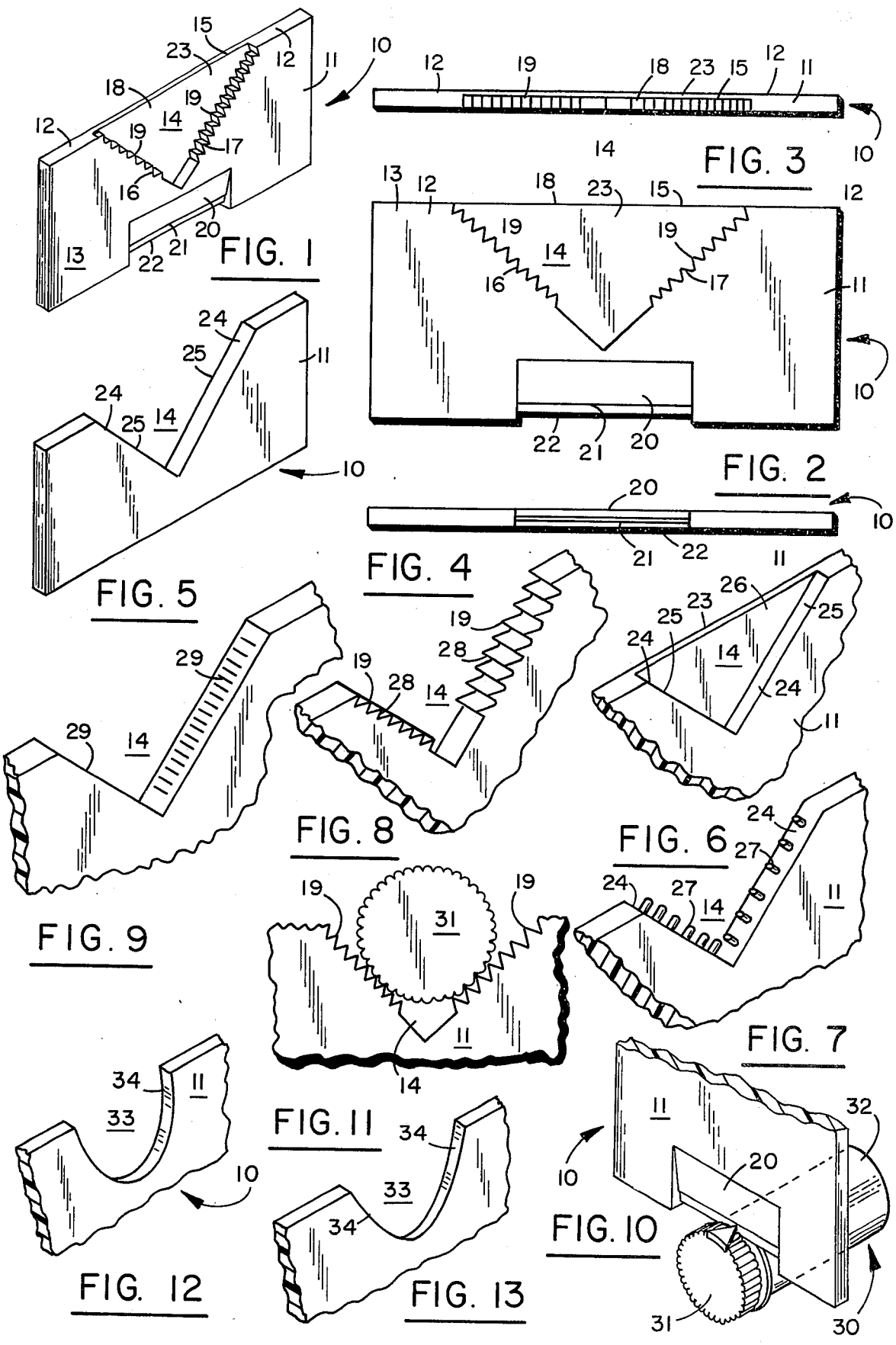
FIG. 1 is a bottom perspective view of the container opener of the embodiment employing teeth and a blade.
FIG. 2 is a bottom plan view of the container opener shown in FIG. 1.
FIG. 3 is a side elevation view of the container opener and the notch shown in FIG. 1.
FIG. 4 is the opposite side elevation view of the container opener and the blade Shown in FIG. 1.
FIG. 5 is a bottom perspective view of the container opener illustrating the notch surface.
FIG. 6 is a bottom fragmentary perspective view of the container opener illustrating the alignment wall.
FIG. 7 is a bottom fragmentary perspective view of the container opener illustrating the embodiment employing a plurality of protrusions.
FIG. 8 is a bottom fragmentary perspective view of the container opener illustrating the embodiment employing teeth and the embodiment employing a sawtooth surface.
FIG. 9 is a bottom fragmentary perspective view of the container opener illustrating the embodiment employing ribs.
FIG. 10 is a perspective view of a container and a fragmentary perspective view of the container opener showing the blade inserted between the cover and the receptacle of the container.
FIG. 11 is a plan view of the cover of the container and a fragmentary plan view of the container opener of the embodiment employing triangular shaped pointed teeth.
FIG. 12 is a fragmentary perspective view of the container opener of the embodiment employing a hole in the shape of half a circle.
FIG. 13 is a fragmentary perspective view of the container opener of the embodiment employing a hole in the shape of a parabola.

Reference is now made to the accompanying drawings for a better understanding of the invention, wherein all the parts are numbered.

In the embodiment shown in FIG. 1 a container opener 10 for child resistant containers is shown comprising a plastic body 11 having a side surface 12 and a bottom surface 13, a notch 14 in the bottom surface 13, the notch 14 generally in the shape of an isosceles right triangle having a hypotenus length 15 on the side surface 12 of the body 11 and a first nonhypotenus length 16 and a second nonhypotenus length 17, and an opening 18 in the side surface 12 of the body 11 along the hypotenus length 15 of the notch 14. The container opener 10 further comprises a plurality of triangular shaped pointed teeth 19 coupled to the first nonhypotenus length 16, and the second nonhypotenus length 17, the teeth 19 extending into the notch 14.

The container opener 10 further comprises a blade 20 formed by a thin section of the body 11 having a prying edge 21 recessed in the body 11. A metal plate 22 is sonic welded to the prying edge 21 of the blade 20 and extends therefrom. An alignment wall 23 is coupled to the body 11 over the notch 14 and extends from the hypotenus length 15 of the notch 14 to the first nonhypotenus length 16 of he notch 14 and to the second nonhypotenus length 17 of the notch 14.

An embodiment shown in FIG. 1 represents one of the best modes of carrying out the invention herein. FIG. 2 and FIG. 3 are drawings of different views of the same embodiment shown in FIG. 1. A preferred embodiment of the invention features a plastic body 11 although the invention may be made of other materials such as metal, wood or other suitable materials or combinations thereof. Plastic is a preferred embodiment because it is relatively light weight, easily shaped, among other features.

A preferred shape of the notch 14 is that of an isosceles right triangle. Most child resistant containers 30 will have a cylindrical shaped cover 31 as shown in FIG. 10 and FIG. 11. A right triangular shape results in a first nonhypotenus length 16 and a second nonhypotenus length 17 which are tangent to the circumference of the cover 31 at the point of contact with the cover 31 regardless of the diameter of the cover 31, thus accomodates any size diameter cover 31.

Said preferred embodiment features an opening 18 in the side surface 12 of the body 11 along the hypotenus length 15 of the notch 14 in order that a cover 31 may be slid into the notch 14 regardless of the size of the cover 31. If there were no such opening 18, then the size of the notch 14 would have to be very large in order to accomodate the various different sized covers.

The embodiment shown in FIG. 1, 2 and 3 features a plurality of triangular shaped pointed teeth 19 coupled to the first nonhypotenus length 16 and to the second nonhypotenus length 17, the teeth extending into the notch 14. The triangular shaped pointed teeth 19 facilitate the gripping of a cover 31 as shown in FIG. 11. Most covers have a ribbed edge along the circumference which allows the teeth 19 to easily grip the cover 31.

The preferred embodiment shown in FIGS. 1, 2, 3 and 10 features a blade 20 formed by a thin section of the body 11. The blade 20 may be formed in the body 11 by filing, carving, or grinding the body 11 until a part of the body 11 becomes thin. The purpose of the blade is illustrated in FIG. 10 where a child resistant container is indicated generally by 30 which has a cover 31 and a receptacle 32 where the cover is attached to the receptacle and aligned to the desired position by inserting the cover 31 into the notch 14 as shown in FIG. 11 and pressing the cover 31 against the triangular shaped pointed teeth 19 so that the container opener 10 when rotated will cause the cover 31 to rotate to the desired position which is usually indicated by an arrow on the container and then the blade 20 is inserted between the cover 31 and the receptacle 32 as shown in FIG. 10 and the container opener is then rotated causing the cover 31 to be expelled from the receptacle 32. The cover 31 is removed by a process similar to prying.

A preferred embodiment shown in FIGS. 1, 2 and 10 features a blade 20 having a prying edge 21 recessed in the body 11 so that the blade will be safely recessed into the body 11 decreasing the chance that the blade will cut one's fingers. To increase the durability of the blade 20 a metal plate 22 is attached to the prying edge 21 of the blade 20 by sonic welding the metal plate 22 to the prying edge 21. A metal plate 22 is utilized because the plastic often becomes and is brittle and may eventually chip after extended use.

A preferred embodiment shown in FIGS. 1, 2, 3, 4 and 6 features an alignment wall 23 coupled to the body 11 over the notch 14 extending from the hypotenus length 15 of the notch 14 to the first nonhypotenus length 16 and to the second nonhypotenus length 17 of the notch 14. The alignment wall 23 facilitates aligning the cover 31 of the child resistant container 30 by allowing the top of the cover to butt up against the alignment wall and holding the cover 31 in position while it is being rotated by the turning of the container opener 10. The cover 31 can also be turned while it is positioned against the triangular shaped pointed teeth by rotating the receptacle 32 instead of the container opener 10.

In the embodiment shown in FIG. 5 a container opener 10 for child resistant containers is indicated generally comprising a body 11 having a notch 14 and a notch surface 24 and friction means 25 on the notch surface 24. This is one of the simplest forms of the invention. The notch 14 may have a variety of shapes although its preferred shape is that of a right triangle so that virtually any size cover 31 may be inserted into the notch 14. The friction means may comprise a plurality of protrusions 27 extending into the notch as shown in FIG. 7 or may comprise a notch sawtooth surface 28 as shown in FIG. 8 or may comprise a plurality of triangular shaped pointed teeth 19 as shown in FIGS. 1, 2 and 8 or may comprise a plurality of ribs 29 extending into the notch 14 as shown in FIG. 9 or may comprise an adhesive substance, not shown, or may comprise a compressible substance, not shown. The adhesive substance could be tape, not shown. A compressible substance could be rubber or any other similar substance.

The purpose of the friction means is to engage the cover 31 of the child resistant container 30 and to hold the cover 31 while the receptacle 32 is aligned with the cover 31. This is usually accomplished by rotation. It is readily apparent also that one could grasp the receptacle 32 and rotate the cover 31 while the friction means is engaging the cover thereby causing the cover to rotate to the aligned position. The position of alignment differs for different child resistant containers and is usually found by lining up a marking on the receptacle 32 with a marking on the cover 31 of the child resistant container 30.

A blade 20 is coupled to the body 11 in a similar manner as that shown in FIG. 1 so that the simple embodiment of the invention shown in FIg. 5 can also be employed with a blade 20. And likewise the embodiment shown in FIG. 5 can be employed with a blade 20 which is a thin section of the body 11 and has a prying edge 21 recessed in the body 11 and a metal plate 22 is coupled to the prying edge 21 and extends therefrom, similar to that shown in FIG. 1. A preferred embodiment still employs a plastic body 11 and a metal plate sonic welded to the prying edge 21, similar to that shown in FIG. 1.

The simple embodiment of FIG. 5 can further utilize alignment means 26 coupled to the body 11 over the notch 14 as shown in FIG. 6. In a preferred embodiment the alignment means 26 comprises a wall 23 coupled to the body 11 over the notch 14 as shown in FIG. 6.

In the embodiment shown in FIG. 5 it is a preferred embodiment that the notch have a substantially triangular shape, and it is further preferred that it be a substantially isosceles right triangular shape.

In the embodiment shown in FIG. 12 a container opener 10 is indicated generally comprising a body 11 having a hole 33 and a surface 34 partially surrounding the hole 33 and friction means on the surface 34 partially surrounding the hole 33. It is a preferred embodiment that the hole 33 is substantially in the shape of a half circle so that circular shaped and cylindrical shaped covers 31 can be inserted therein. Another preferred embodiment is that the hole is substantially in the shape of a parabola so that virtually any shape of a cover 31 can be inserted therein and accomodated.

It is to be understood that the invention is not limited to the exact details of construction, operation, or exact materials or embodiments shown and described, as obvious modifications and equivalents will be apparent to one skilled in the art, and the invention is therefore to be limited only by the scope of the appended claims.

I claim:

1. A container opener for child resistant containers, comprising:

a body having a bottom surface, a notch in the bottom surface, and a notch surface;

friction means on the notch surface; and a blade coupled to the body wherein the blade is a thin section of the body and has a prying edge recessed in the body and a metal plate is coupled to the prying edge and extends therefrom wherein the body is plastic and the metal plate is sonic welded to the prying edge.

2. A container opener for child resistant containers, comprising:

a plastic body having a side surface and a bottom surface, a notch in the bottom surface, the notch generally in the shape of an isosceles right triangle having a hypotenus length on the side surface of the body and a first nonhypotenus length and a second nonhypotenus length, and an opening in the side surface of the body along the hypotenus length of the notch;

a plurality of triangular shaped pointed teeth coupled to the first nonhypotenus length, the teeth extending into the notch;

a plurality of triangular shaped pointed teeth coupled to the second nonhypotenus length, the teeth extending into the notch;

a blade formed by a thin section of the body having a prying edge recessed in the body;

a metal plate sonic welded to the prying edge of the blade and extending therefrom; and an alignment wall coupled to the body over the notch extending from the hypotenus length of the notch to the first nonhypotenus length of the notch and to the second nonhypotenus length of the notch.

* * * * *